US007007987B2

(12) United States Patent
Walls et al.

(10) Patent No.: US 7,007,987 B2
(45) Date of Patent: Mar. 7, 2006

(54) SPINDLE FOR A DOOR HANDLE ASSEMBLY

(75) Inventors: Christopher G. Walls, Rockford, IL (US); Stanley R. Reeves, Batavia, IL (US)

(73) Assignee: Newell Operating Company, Atlanta, GA (US)

( * ) Notice: Subject to any disclaimer, the term of this patent is extended or adjusted under 35 U.S.C. 154(b) by 14 days.

(21) Appl. No.: 10/659,761

(22) Filed: Sep. 10, 2003

(65) Prior Publication Data

US 2004/0113442 A1 Jun. 17, 2004

Related U.S. Application Data

(60) Provisional application No. 60/409,784, filed on Sep. 11, 2002.

(51) Int. Cl.
*E05B 3/00* (2006.01)

(52) U.S. Cl. ..... 292/358; 292/DIG. 64

(58) Field of Classification Search ..... 292/358, 292/359, 336.5, 169.16, DIG. 64
See application file for complete search history.

(56) References Cited

U.S. PATENT DOCUMENTS

| | | | | | |
|---|---|---|---|---|---|
| 4,883 | A | * | 12/1846 | Livingston | 292/358 |
| 186,018 | A | * | 1/1877 | Burgess | 292/358 |
| 472,725 | A | * | 4/1892 | Smith | 292/358 |
| 506,388 | A | * | 10/1893 | Clark | 292/355 |
| 3,954,292 | A | | 5/1976 | Johnson | |
| 5,906,403 | A | | 5/1999 | Bestler et al. | |

* cited by examiner

*Primary Examiner*—Gary Estremsky
(74) *Attorney, Agent, or Firm*—Wallenstein Wagner & Rockey, Ltd.

(57) ABSTRACT

A spindle for a door assembly includes a first member and a second member. The first and second members each have a base, a first leg and a second leg extending from the base. The second leg is recessed relative to the first leg. The first member confronts the second member such that the first leg of the first member confronts the second leg of the second member and the second leg of the first member confronts the first leg of the second member forming the spindle.

18 Claims, 3 Drawing Sheets

SPINDLE FOR A DOOR HANDLE ASSEMBLY

RELATED APPLICATION

This application claims priority from and claims the benefit of U.S. Provisional Application No. 60/409,784, filed on Sep. 11, 2002, which application is incorporated herein by reference and made a part hereof.

TECHNICAL FIELD

The present invention pertains to a spindle used in a door handle assembly. More particularly, the present invention pertains to a dual member spindle configured to be connected to a door handle using a set screw.

BACKGROUND OF THE INVENTION

Spindles used in door handle assemblies are generally known in the art. Some door assemblies use a set screw to secure the door handle to the spindle. In such an arrangement, the set screw is inserted into an opening in the handle and embedded into the spindle, thereby connecting the handle to the spindle. For proper spindle performance, it is important that the spindle is properly installed, enabling the set screw to maintain a secure connection with the spindle. It is desirable that the set screw is aligned to engage a seam formed between the parts of the spindle. In the event that the set screw is misaligned during installation, it is desirable that the spindle provide one or more thin walls capable of deflection or penetration by the set screw. One disadvantage of conventional spindle arrangements is that they generally provide a limited number of thin walls capable of penetration by a set screw. FIG. 1 illustrates a prior art spindle assembly having a pair of members 2, 4 each having at least one thin wall portion 6. One disadvantage of this design is that if the spindle is improperly installed, the set screw 10 will engage a thick wall portion 8 of the spindle, preventing the set screw 10 from becoming properly embedded in the spindle.

In addition, and as shown in FIG. 2, the spindle members 2 and 4 are configured in such a manner that allows them to be improperly installed. As illustrated, the spindle member 2,4 can be improperly arranged such that the back portion of member 2 confronts the front portion of member 4. In this configuration, the set screw 10 attempts to embed in a thick wall portion of the spindle member 2. However, such an engagement provides a less rigid connection, increasing the possibility for the door handle to become disengaged from the spindle. Other known designs include a spindle 12 having a rubber or resilient core 14 configured to receive a screw 16, illustrated in FIG. 3. One disadvantage of such an arrangement, is that the connection between the screw 16 and the resilient core 14 can become unstable. Accordingly, it is possible that the screw 16 may disengage the spindle 12, rendering the door assembly inoperable.

The present invention is provided to solve these and other problems.

SUMMARY OF THE INVENTION

The present invention provides a spindle for a door assembly.

According to one aspect of the invention, the spindle comprises a first member having a base and a first leg extending from the base and a second leg extending from the base and a second member having a base and a first leg extending from the base and a second leg extending from the base. The first member confronts the second member. As such, the first leg of the first member confronts the second leg of the second member and the second leg of the first member confronts the first leg of the second member.

According to another aspect of the invention, the second leg of the first member is recessed relative to the first leg of the first member and the second leg of the second member is recessed relative to the first leg of the second member.

According to another aspect of the invention, the first member includes a semi-circular cavity defining a first tapered portion in the first leg, and a second tapered portion in the second leg and a thin section in the base. The second member includes a semi-circular cavity defining a first tapered portion in the first leg, a second tapered portion in the second leg and a thin section in the base.

According to another aspect of the invention, the first member confronts the second member wherein the first tapered portion of the first member confronts the second tapered portion of the second leg and the second tapered portion of the first member confronts the first tapered portion of the second member.

According to another aspect of the invention, the first leg of the first member includes a first pillar and the second leg of the first member includes a second pillar and the first leg of the second member includes a first pillar, and the second leg of the second member includes a second pillar, cooperatively forming a bow adapted to provide an interference fit to secure the spindle in an opening formed in a door member.

Other features and advantages of the invention will be apparent form the following specification taken in conjunction with the following drawings.

BRIEF DESCRIPTION OF THE DRAWINGS

In the accompanying drawings forming part of the specification, and in which like numerals are employed to designate like parts throughout the same.

DETAILED DESCRIPTION OF THE DRAWINGS

Figure 1:
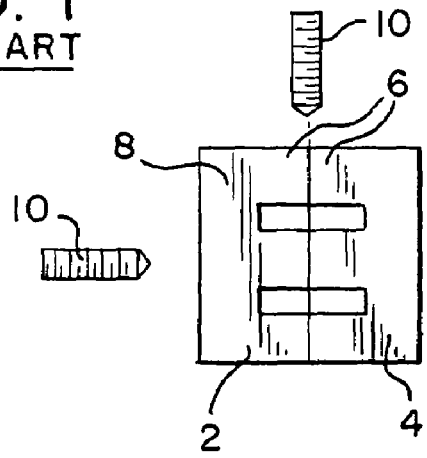
FIG. 1 PRIOR ART
FIG. 1 is a schematic end view of a prior art spindle assembly and set screw.
Figure 2:
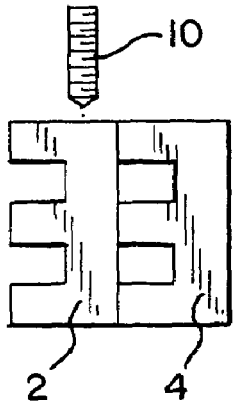
FIG. 2 PRIOR ART
FIG. 2 is a schematic end view of the spindle assembly of FIG. 1, illustrating spindle members in an improperly installed arrangement.
Figure 3:
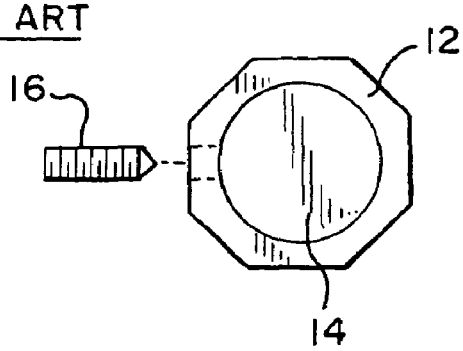
FIG. 3 PRIOR ART
FIG. 3 is a schematic cross-sectional view of another prior art spindle assembly.

While this invention is susceptible of embodiments in many different forms, there is shown in the drawings and will herein be described in detail a preferred embodiment of the invention with the understanding that the present disclosure is considered to be an exemplification of the principles of the invention and is not intended to limit the broad aspect of the invention to coupling assembly the embodiments illustrated.

Figure 4:
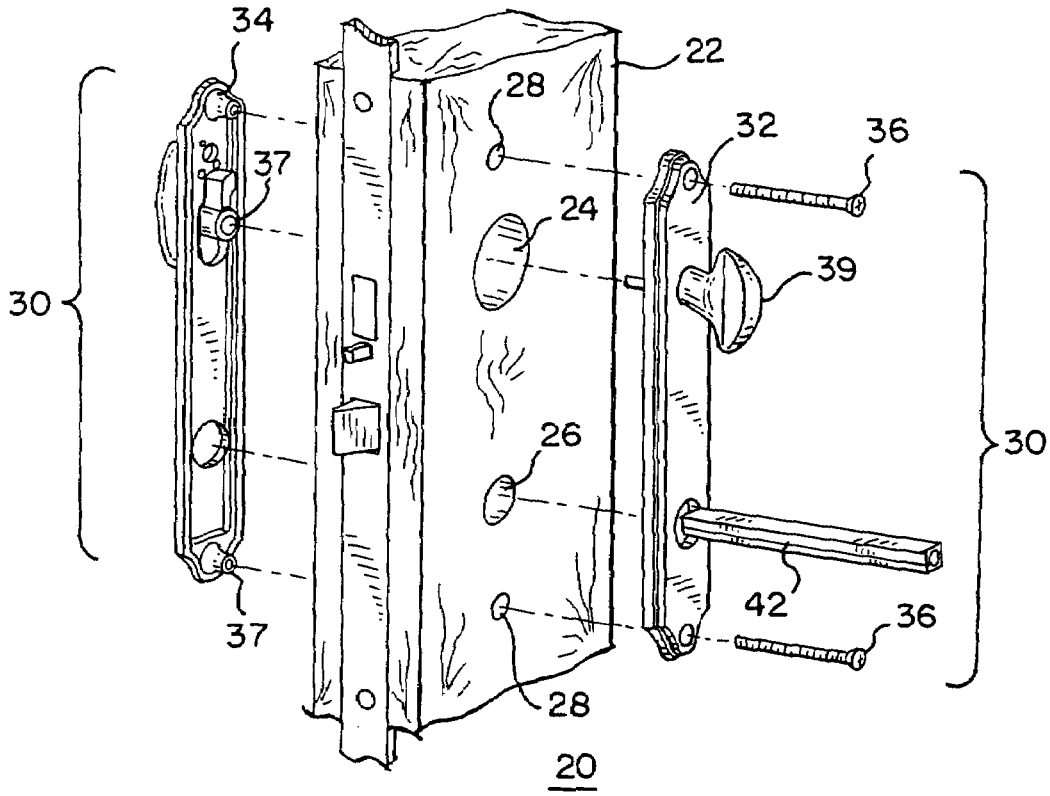
FIG. 4 is an exploded partial view of a door assembly having a door handle assembly.
Figure 5:
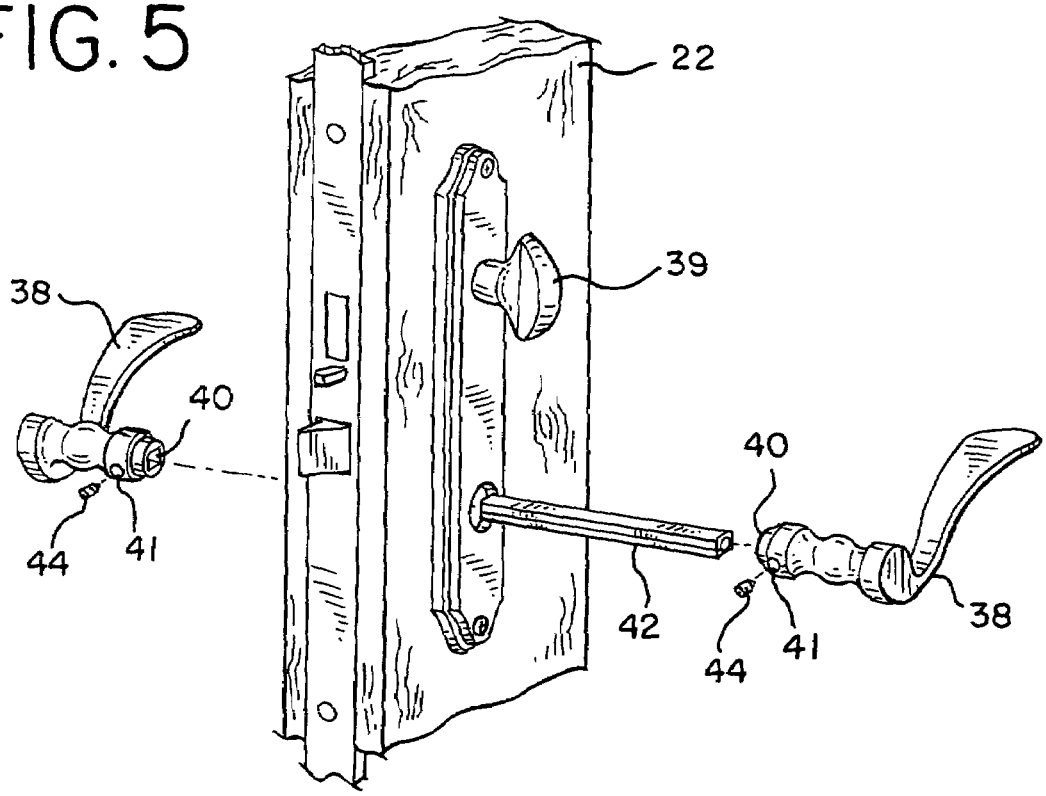
FIG. 5 is an exploded partial view of view of the door assembly of FIG. 4, illustrating a handle/spindle/set screw arrangement of the door handle assembly.
Figure 7:
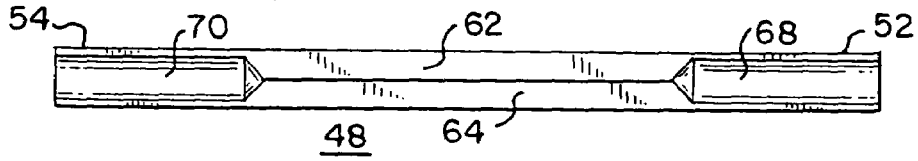
FIG. 7 is a top plan view of the spindle member.

Referring now to FIG. 4, there is shown an exploded partial view of a door assembly 20. The door assembly 20 includes a door member 22 pivotally supported in a door frame (not shown). The door member 22 can be constructed from wood, metal or virtually any material without departing from the scope of the present invention. The door member 22 includes an upper bore 24, a lower bore opening 26, and one or more fastening bores 28, adapted for receiving a door handle assembly 30.

The handle assembly 30 includes an interior escutcheon 32, an exterior escutcheon 34, a fastening member 36, a door handle or lever 38, a locking mechanism 39, a spindle 42, and a set screw or fastener 44. The interior escutcheon 32 engages one side of the door member 22 and exterior escutcheon 34 engages the other side of the door member 22. The exterior escutcheon 34 includes one or more hub members 37 adapted for insertion into bore 28. Similarly, the interior escutcheon 32 can also include one or more hub members (not shown) adapted for insertion into bore 28.

Figure 10:
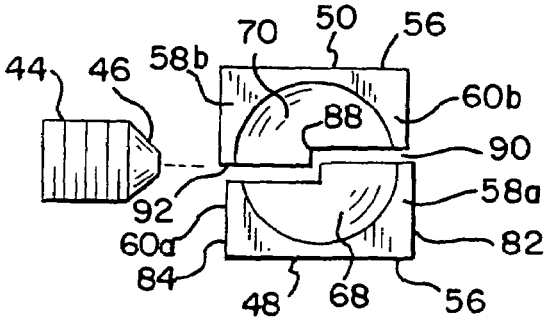
FIG. 10 is a schematic view of a pair of spindle members and a set screw.

Fastening members 36 are inserted into the bores 28, to fasten the exterior and interior escutcheons 34, 32 to the door member 22. The locking mechanism 39 is inserted into the upper bore 24 of the door member 22 and cooperatively engages the exterior escutcheon 34. The door handle 38 includes an opening 40, adapted to receive the spindle 42. The handle 38 further includes a second opening 41 adapted to receive the set screw 44 or a like fastening member. As shown in FIG. 10, the set screw 44 has a generally cylindrical shape, including a tapered tip portion 46.

The spindle 42 is adapted for insertion into the lower opening 26 of the door member 22. The spindle 42 operatively engages the door handle 38. As shown in FIG. 10, the spindle 42 generally comprises a first spindle member 48 and a second spindle member 50. As explained in greater detail below, the spindle members 48, 50 can be configured into a specific confronting relation to define a predetermined outer dimension corresponding to the door handle opening 40. The spindle members 48, 50 are generally identical. FIGS. 6–9 illustrate one of the spindle members 48. Accordingly, the first spindle member 48 will be described in detail with the understanding that the description is applicable to the second spindle member 50.

Figure 6:
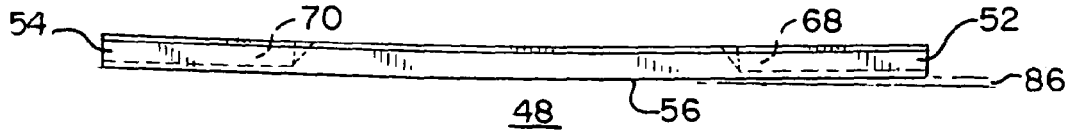
FIG. 6 is a front elevation view of a spindle member of the door assembly embodying the principles of the present invention.
Figure 8:
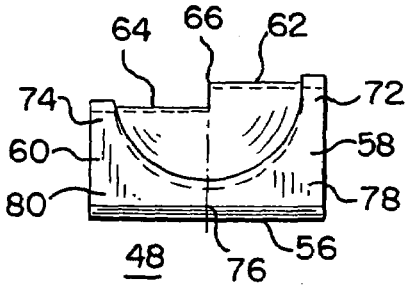
FIG. 8 is an end view of the spindle member.
Figure 9:
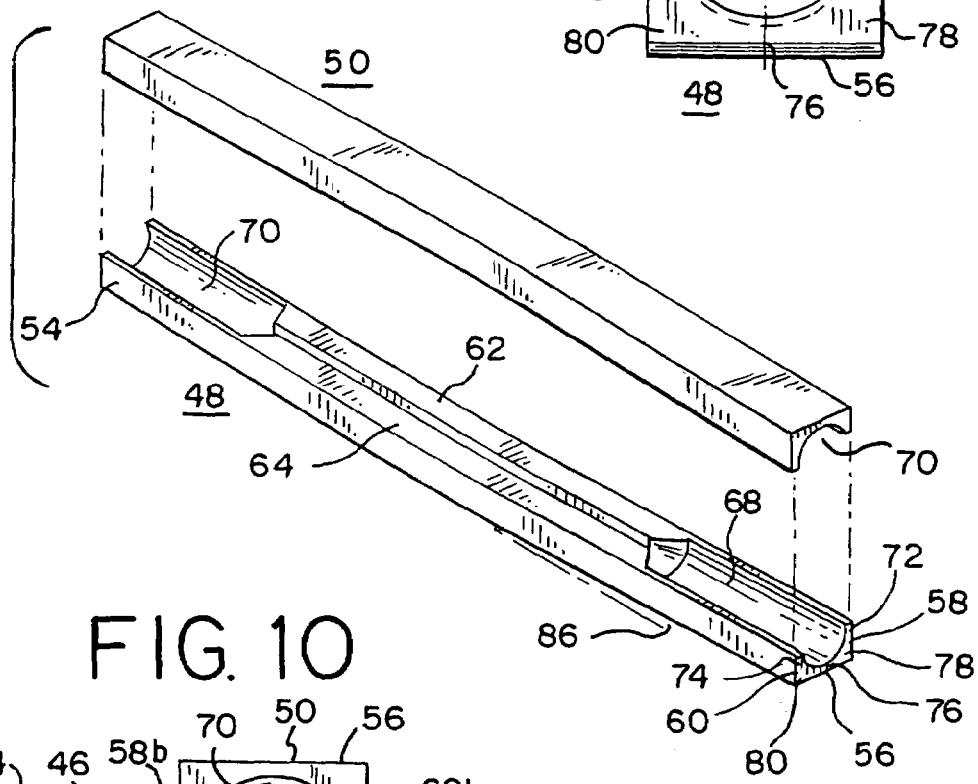
FIG. 9 is a schematic perspective view of the spindle member.

FIG. 6 shows the spindle member 48. The spindle member 48 has a generally elongated rod-shaped configuration having a first end 52 and a second end 54. The spindle member 48 generally includes a base 56, a first leg 58 and a second leg 60. The base 56 has a generally planar configuration. However, it is contemplated that the base 56 can have virtually any shape without departing from the scope of the present invention.

The first leg 58 projects generally perpendicularly outwardly from the base 56. The first leg 58 extends between the first end 52 and second end 54 of the base 56. Preferably, the first leg 58 has a length approximately equal to the length of base 56. The second leg 60 projects generally perpendicularly outwardly from the base 56. The second leg 60 extends between the first end 52 and second end 54 of the base 56. Preferably, the second leg 60 has a length approximately equal to the length of the base 56. The first leg 58 and second leg 60 have different heights. Preferably, the height of the first leg 58 is greater than the height of the second leg 60 such that the second leg 60 is recessed relative to the first leg 58.

The first leg 58 includes a first pillar 62. In the present embodiment, the first pillar 62 is positioned proximate to a central portion of the first leg 58. Preferably, the first pillar 62 has a width approximately equal to half the width of the base 56. The second leg 60 includes a second pillar 64. The second pillar 64 is positioned proximate to a generally central portion of the second leg 60. Preferably, the second pillar 64 has a width equal to approximately half the width of the base 56. In the present embodiment, the first pillar 62 has a height greater than the second pillar 64 height such that the second pillar 64 is recessed relative to the first pillar 62. Preferably, the second pillar 64 and first pillar 62 engage each other proximate to the mid-width of the spindle member 42, forming a step 66.

A generally semi-circular cavity 68, 70 is formed proximate to the respective first and second ends 52, 54 of the spindle member 48. The cavity 68, 70 extends generally from the respective first and second ends 52, 54 of the spindle to the respective pillars 62, 64. As shown, the semi-circular cavity 68 forms a first tapered portion 72 in the first leg 58, a second tapered portion 74 in the second leg 60, and a generally thin wall section 76 in the base 56. The thin wall section 76 is generally thinner in width than the peripheral corner portions 78, 80 of the base 56. Similarly, proximate to the second end 54, the semi-circular cavity 70 forms a first tapered portion 72 in the first leg, a second tapered portion 74 in the second leg, and a generally thin wall section in the base 56.

As explained in greater detail below, each spindle member 48, 50 is bowed at a central portion thereof. When the spindle members 48, 50 are properly positioned to form the spindle 42, the bowed portions cooperate with the lower bore opening 26 of the door member 22 to provide an enhanced fit.

Referring now to FIG. 10, there is shown a view of the spindle members 48,50 in a confronting position to form the spindle 42. In this arrangement, the bases 56 of the respective spindle members 48,50 are in a generally spaced relationship. The first leg 58*a* of the first member 48 confronts the second leg 60*b* of the second member 50, and the second leg 60*a* of the first member 48 confronts the first leg 58*b* of the second member 50. In this manner, the outer portions of the first leg 58 and second leg 60, in combination, define the outer walls 82,84 of the spindle 42. As illustrated, the outer walls 82,84 are in a generally spaced relationship. Seams 90, 92 are formed between the cooperating first and second legs in the respective outer walls 82 and 84. The seam 92 is adapted to receive the set screw 44.

The first pillar 62 of the first member 48 confronts the second pillar 64 of the second member 50 and the second pillar 64 of the first member 48 confronts the first pillar 62 of the second member 50, forming a bow 86 at a central portion of the spindle 42.

Further, the first tapered portion 74 of the first leg 58 confronts the second tapered portion 76 of the second leg 60. The second tapered portion 76 of the second leg 60 confronts the first tapered portion 74 of the first leg 58. The semi-circular cavity 68 formed in the first spindle member 48 and the semi-circular cavity 70 formed in the second spindle member 50 define a circular cavity 88 formed in the end of the spindle. In a confronting position, the bases and walls form the spindle. As such, the spindle 42 has a peripheral configuration having a predetermined outer dimension. This outer dimension will correspond to the opening 40 in the door handle 38.

In the door handle assembly 30, the first end 52 of the spindle 42 is inserted into the opening 26. The second end 54 of the spindle 42 received by the opening 40 in the door handle 38. As such, the bow 86 engages the opening 26, creating a secure interference fit therewith. The set screw 44 is inserted into the opening 41 in the handle 38. The set screw 44 engages one of the thinned bases 56 or sidewalls 82, 84 of the spindle 42 connecting the handle 38 to the spindle 42. Preferably, the spindle 42 is orientated in the door handle 38 such that the set screw 44 engages one of the seams 90 or 92 formed between the side walls 82, 84, providing a secure connection with the spindle 42.

The benefits of the present spindle assembly 42 are apparent. The spindle 42 includes a plurality of thin walls, which enables embedded connection by the set screw 44 regardless of the orientation of the spindle 42 in the handle 38. In the event that the spindle 42 is improperly positioned in the handle opening, the first leg 58 of the first and second spindle member 48, 50 extends outwardly, preventing the spindle 42 from being improperly installed in the handle 38 and door member 22. Further, in the event that the first and second spindle members 48, 50 are improperly installed such that the base 56 of one member confronts the pillars 62, 64 of the other member, the extending first legs and first pillars prevent the first and second member from mounting to form the spindle 42. In these improper configurations, the outer dimensions of the spindle members 48, 50 will exceed the predetermined outer dimension of a properly configured spindle 42. In such case, the spindle 42 in an improper configuration will not fit into the opening 40 of the door handle 38. In a proper confronting position, the first and second pillars 62, 64 of the first and second members 48, 50 cooperatively form a bow 86. When the spindle 42 is inserted in the opening 26 of the door member 22, the bow 86 provides a secure interference fit with the opening 26.

It will be understood that the invention may be embodied in other specific forms without departing from the spirit or central characteristics thereof. The present embodiments, therefore, are to be considered in all respects as illustrative and not restrictive, and the invention is not to be limited to the details given herein.

What is claimed is:

1. A spindle for a door assembly comprising:

a first member having a base, a first leg extending from the base and a second leg extending from the base, and a semi-circular cavity defining a first tapered portion in the first leg, a second tapered portion in the second leg and a thin section in the base; and, a second member having a base, a first leg extending from the base and a second leg extending from the base, and a semi-circular cavity defining a first tapered portion in the first leg, a second tapered portion in the second leg and a thin section in the base, the first member confronting the second member wherein the first leg of the first member confronts the second leg of the second member and the second leg of the first member confronts the first leg of the second member.

2. The spindle of claim 1, wherein the second leg of the first member is recessed relative to the first leg of the first member.

3. The spindle of claim 1, wherein the second leg of the second member is recessed relative to the first leg of the second member.

4. The spindle of claim 1, wherein the second leg of the first member is recessed relative to the first leg of the first member and the second leg of the second member is recessed relative to the first leg of the second member.

5. The spindle of claim 1, the first member confronting the second member wherein the first tapered portion of the first member confronts the second tapered portion of the second leg and the second tapered portion of the first member confronts the first tapered portion of the second member.

6. The spindle of claim 1, wherein the first leg of the first member includes a first pillar and the second leg of the first member includes a second pillar.

7. The spindle of claim 1, wherein the first leg of the second member includes a first pillar, and the second leg of the second member includes a second pillar.

8. The spindle of claim 1, wherein the first member and second member in confronting relationship cooperating first and second legs form a seam adapted to receive a set screw for fastening the spindle to a door handle.

9. A spindle for a door assembly, comprising:

a first member having a base and a first leg extending from the base and a second leg extending from the base, the second leg of the first member being recessed relative to the first leg of the first member, the first leg of the first member including a first pillar and the second leg of the first member including a second pillar; and, a second member having a base and a first leg extending from the base and a second leg extending from the base, the second leg of the second member being recessed relative to the first leg of the second member, and the first leg of the second member including a first pillar and the second leg of the second member including a second pillar;

the first member confronting the second member wherein the first leg of the first member confronts the second leg of the second member and the second leg of the first member confronts the first leg of the second member, and wherein the first pillar of the first member confronts the second pillar of the second member and the second pillar of the first member confronts the first pillar of the second member.

10. The spindle of claim 9, the first member including a semi-circular cavity defining a first tapered portion in the first leg, a second tapered portion in the second leg and a thin section in the base, and, the second member including a semi-circular cavity defining a first tapered portion in the first leg, a second tapered portion in the second leg and a thin section in the base, the first member confronting the second member wherein the first tapered portion of the first member confronts the second tapered portion of the second leg and the second tapered portion of the first member confronts the first tapered portion of the second member forming at least one thin outer wall having a seam.

11. The spindle of claim 9, wherein the first and second pillars of the first member and second member cooperatively form a bow to provide an interference fit with an opening formed in a door member.

12. A spindle for a door assembly comprising:

a first member comprising a base and a first leg extending from the base and a second leg extending from the base, the second leg being recessed relative to the first leg, the first member further comprising a semi-circular cavity defining a first tapered portion in the first leg, a second tapered portion in the second leg and a thin section in the base, the first leg of the first member includes a first pillar, the second leg of the first member includes a second pillar; and, a second member having a base and a first leg extending from the base and a second leg extending from the base being recessed relative to the first leg, the second member including a semi-circular cavity defining a first tapered portion in the first leg, a second tapered portion in the second leg and a thin section in the base, the first leg of the second member includes a first pillar, and the second leg of the second member includes a second pillar;

the first member confronting the second member wherein the first leg of the first member confronts the second leg of the second member, the second leg of the first member confronts the first leg of the second member, the first tapered portion of the first member confronts the second tapered portion of the second leg and the second tapered portion of the first member confronts the first tapered portion of the second member forming at least one thin outer wall having a seam, and the first pillar of the first member confronts the second pillar of the second member and the second pillar of the first member confronts the first pillar of the second member.

13. A door assembly comprising:

a door member including at least one bore formed therein adapted to receive a spindle;

a door handle assembly configured for connection to the door member comprising a spindle adapted for insertion into the door member, the spindle having a first member and a second member, the first member having a base, a first leg extending from the base and a second leg extending from the base, and a semi-circular cavity defining a first tapered portion in the first leg, a second tapered portion in the second leg and a thin section in the base, the second leg of the first member being recessed relative to the first leg of the first member, and the second member having a base, a first leg extending from the base and a second leg extending from the base, and a semi-circular cavity defining a first tapered portion in the first leg, a second tapered portion in the second leg and a thin section in the base, the second leg of the second member being recessed relative to the first leg of the second member, wherein the first member confronts the second member, the first leg of the first member confronting the second leg of the second member and the second leg of the first member confronting the first leg of the second member; and, at least one door handle comprising an aperture adapted to receive the spindle enabling connection to the door member.

14. The door handle assembly of claim 13, wherein the door handle comprises an aperture for receiving a set screw.

15. The door handle assembly of claim 14, further comprising a set screw adapted for insertion into an opening formed in the door handle for securely fastening the door handle to the spindle.

16. The door handle assembly of claim 13, further comprising a first escutcheon adapted for connection with one surface of the door member and a second escutcheon adapted for connection with a second surface of the door member.

17. A spindle for a door assembly comprising:

a first member having a base and a first leg extending from the base and a second leg extending from the base, wherein the first leg of the first member includes a first pillar and the second leg of the first member includes a second pillar; and, a second member having a base and a first leg extending from the base and a second leg extending from the base, wherein the first leg of the second member includes a first pillar, and the second leg of the second member includes a second pillar, the first member confronting the second member wherein the first leg of the first member confronts the second leg of the second member and the second leg of the first member confronts the first leg of the second member, and the first pillar of the first member confronts the second pillar of the second member and the second pillar of the first member confronts the first pillar of the second member cooperatively forming a bow adapted to provide an interference fit to secure the spindle in an opening formed in a door member.

18. A spindle for a door assembly, comprising:

a first member having a base, a first leg extending from the base and a second leg extending from the base, and a semi-circular cavity defining a first tapered portion in the first leg, a second tapered portion in the second leg and a thin section in the base, the second leg of the first member being recessed relative to the first leg of the first member; and, a second member having a base, a first leg extending from the base and a second leg extending from the base, and a semi-circular cavity defining a first tapered portion in the first leg, a second tapered portion in the second leg and a thin section in the base, the second leg of the second member being recessed relative to the first leg of the second member;

the first member confronting the second member wherein the first leg of the first member confronts the second leg of the second member and the second leg of the first member confronts the first leg of the second member, and wherein the first tapered portion of the first member confronts the second tapered portion of the second leg and the second tapered portion of the first member confronts the first tapered portion of the second member forming at least one thin outer wall having a seam.

* * * * *